US011837132B2

(12) United States Patent
Lee et al.

(10) Patent No.: US 11,837,132 B2
(45) Date of Patent: Dec. 5, 2023

(54) OUTPUT BUFFER, DATA DRIVER, AND DISPLAY DEVICE HAVING THE SAME

(71) Applicants: Samsung Display Co., Ltd., Yongin-Si (KR); Korea Advanced Institute of Science and Technology, Daejeon (KR)

(72) Inventors: Seong Joo Lee, Yongin-si (KR); Seok Tae Koh, Daejeon (KR); Gyeong Gu Kang, Daejeon (KR); Oh Jo Kwon, Yongin-si (KR); Hyun Sik Kim, Daejeon (KR); Gyu Wan Lim, Daejeon (KR); Keum Dong Jung, Yongin-si (KR)

(73) Assignees: Samsung Display Co., Ltd., Yongin-Si (KR); Korea Advanced Institute of Science and Technology, Daejeon (KR)

( * ) Notice: Subject to any disclaimer, the term of this patent is extended or adjusted under 35 U.S.C. 154(b) by 0 days.

(21) Appl. No.: 17/500,875

(22) Filed: Oct. 13, 2021

(65) Prior Publication Data

US 2022/0335871 A1 Oct. 20, 2022

(30) Foreign Application Priority Data

Apr. 15, 2021 (KR) ..... 10-2021-0049407

(51) Int. Cl.
*G09G 3/20* (2006.01)

(52) U.S. Cl.
CPC ..... *G09G 3/20* (2013.01); *G09G 2300/0426* (2013.01); *G09G 2300/0809* (2013.01); *G09G 2300/0828* (2013.01); *G09G 2310/0243* (2013.01); *G09G 2310/0272* (2013.01); *G09G 2310/0291* (2013.01); *G09G 2310/08* (2013.01)

(58) Field of Classification Search
CPC ..... G09G 3/20; G09G 2300/0426; G09G 2300/0809; G09G 2300/0828
See application file for complete search history.

(56) References Cited

U.S. PATENT DOCUMENTS

| | | | | |
|---|---|---|---|---|
| 8,963,640 | B2 | 2/2015 | Kim et al. | |
| 10,517,021 | B2 * | 12/2019 | Feldman | H04L 65/1016 |
| 10,521,035 | B2 * | 12/2019 | Kang | G06F 3/04182 |
| 11,450,279 | B2 * | 9/2022 | Lee | G09G 3/3275 |

(Continued)

FOREIGN PATENT DOCUMENTS

KR 10-1916224 B1 11/2018

OTHER PUBLICATIONS

Seok-Tae Koh, et al., "A 5V Dynamic Class-C Paralleled Single-Stage Amplifier with Near-Zero Dead-Zone Control and Current-Redistributive Rail-to-Rail Gm-Boosting Technique", 2021 IEEE International Solid-State Circuits Conference (ISSCC), Session 5, Analog Interfaces, 5.8, pp. 86-87 Feb. 13, 2021.

*Primary Examiner* — Sejoon Ahn
(74) *Attorney, Agent, or Firm* — Innovation Counsel LLP

(57) ABSTRACT

An output buffer is disclosed that includes: a buffer circuit that outputs an output signal to an output terminal based on a first input signal provided to a first input terminal and a second input signal provided to a second input terminal; and a current supply circuit that is connected in parallel to the buffer circuit, and provides an auxiliary current to the output terminal based on the first input signal and the second input signal.

16 Claims, 13 Drawing Sheets

(56) References Cited

U.S. PATENT DOCUMENTS

| | | | | |
|---|---|---|---|---|
| 11,501,695 | B2 * | 11/2022 | Yamazaki | G09G 3/3659 |
| 2018/0082638 | A1 * | 3/2018 | Shaeffer | G09G 3/3275 |
| 2019/0035330 | A1 * | 1/2019 | Li | G09G 3/3258 |
| 2019/0035335 | A1 * | 1/2019 | Kim | G09G 3/3258 |
| 2020/0110496 | A1 * | 4/2020 | Lin | G06F 3/0412 |
| 2021/0090513 | A1 * | 3/2021 | Takahashi | G09G 3/3696 |
| 2021/0181561 | A1 * | 6/2021 | Kawashima | G09G 3/3233 |
| 2021/0240056 | A1 * | 8/2021 | Barros | G02B 7/14 |

* cited by examiner

OUTPUT BUFFER, DATA DRIVER, AND DISPLAY DEVICE HAVING THE SAME

CROSS-REFERENCE TO RELATED APPLICATION

This application claims priority to and the benefit of Korean Patent Application No. 10-2021-0049407 filed in the Korean Intellectual Property Office on Apr. 15, 2021, the entire contents of which are incorporated herein by reference.

BACKGROUND

1. Field

The present inventive concept relates to a display device, and more particularly, to an output buffer for transferring a data signal to a display panel, a data driver, and a display device including the same.

2. Description of the Related Art

The display device includes a display panel and a panel driver. The display panel includes a plurality of pixels. The panel driver includes a scan driver that supplies scan signals to the pixels and a data driver that supplies data signals to the pixels. The data driver includes an output buffer connected to a fan-out line or a data line connected thereto.

The output buffer may be implemented as an operational amplifier or the like, and a signal may be output based on a difference (e.g., an input voltage difference) between voltages applied to a non-inverting input terminal and an inverting input terminal of the operational amplifier. Meanwhile, research is underway to improve a slew rate of a signal output from the output buffer according to an increase in a driving frequency of the display device.

SUMMARY

An embodiment of an output buffer applied to a display device according to the present inventive concept includes a buffer circuit that outputs an output signal to an output terminal based on a first input signal provided to a first input terminal and a second input signal provided to a second input terminal; and a current supply circuit that is connected in parallel to the buffer circuit and provides an auxiliary current to the output terminal based on the first input signal and the second input signal.

According to an embodiment, the current supply circuit may include a current source generator that is connected to the first input terminal and generates a first current provided to a first current path or a second current path provided to a second current path based on the first input signal and the second input signal; a first current controller that is connected between the second input terminal and the current source generator and controls the first current based on a third current generated by the first current; a second current controller that is connected between the second input terminal and the current source generator and controls the second current based on a fourth current generated by the second current; a first current output that provides a value obtained by multiplying the first current by K times (where K is a positive real number) as the auxiliary current to the output terminal; and a second current output that allows a value obtained by multiplying the second current by K times as the auxiliary current to flow from the output terminal to a ground.

According to an embodiment, the current source generator may include a first P-type transistor that is connected between a power line and a ground, and has a gate electrode connected to a first node connected to the first input terminal; a first N-type transistor that is connected in parallel to the first P-type transistor between the power line and the ground, and has a gate electrode connected to the first node; a second P-type transistor that is connected between the first N-type transistor and the ground to form the first current path, and has a gate electrode connected to the first current controller; and a second N-type transistor that is connected between the power line and the first P-type transistor to form the second current path, and has a gate electrode connected to the second current controller.

According to an embodiment, the first current controller may function as a constant voltage source and a variable voltage source connected between the second input terminal and the gate electrode of the second P-type transistor, and the second current controller functions as a constant voltage source and a variable voltage source connected between the second input terminal and the gate electrode of the second N-type transistor.

According to an embodiment, the first current controller may control a voltage difference between a gate voltage of the first N-type transistor and a gate voltage of the second P-type transistor to be greater than a preset threshold.

According to an embodiment, the second current controller may control a voltage difference between a gate voltage of the second N-type transistor and a gate voltage of the first P-type transistor to be greater than a preset threshold.

According to an embodiment, the first current controller may include a fifth N-type transistor that is connected between the power line and the ground, and has a gate electrode connected to a second node connected to the second input terminal; a sixth N-type transistor that is connected between the second P-type transistor and the ground, and has a gate electrode and a drain electrode connected to each other; a seventh N-type transistor that is connected between a third node and the ground, and has a gate electrode connected to the gate electrode of the sixth N-type transistor; and a first resistor that is connected between the fifth N-type transistor and the third node. The gate electrode of the second P-type transistor may be connected to the third node.

According to an embodiment, the first current controller may further include an eighth P-type transistor that is connected between the power line and the fifth N-type transistor, and has a gate electrode and a drain electrode connected to each other.

According to an embodiment, the sixth N-type transistor and the seventh N-type transistor may be a current mirror generating a current ratio of b:1 (where b is a real number of 1 or more), and the third current may flow through the seventh N-type transistor based on the first current.

According to an embodiment, the second current controller may include a fifth P-type transistor that is connected between the power line and the ground, and has a gate electrode connected to a second node connected to the second input terminal; a sixth P-type transistor that is connected between the power line and the second N-type transistor, and has a gate electrode and a drain electrode connected to each other; a seventh P-type transistor that is connected between a fourth node and the ground, and has a gate electrode connected to the gate electrode of the sixth P-type transistor; and a second resistor that is connected between the fourth node and the fifth P-type transistor. The gate electrode of the second N-type transistor may be connected to the fourth node.

According to an embodiment, the second current controller may further include an eighth N-type transistor that is connected between the fifth P-type transistor and the ground, and has a gate electrode and a drain electrode connected to each other.

According to an embodiment, the sixth P-type transistor and the seventh P-type transistor may be a current mirror generating a current ratio of b:1 (where b is a real number of 1 or more), and the fourth current may flow through the seventh P-type transistor based on the second current.

According to an embodiment, the current supply circuit may include a first bias current source that is connected between the third node and the ground; and a second bias current source that is connected between the power line and the fourth node.

According to an embodiment, the first current output may include a third P-type transistor that is connected between the power line and the first N-type transistor, and has a gate electrode and a drain electrode connected to each other; and a fourth P-type transistor that is connected between the power line and the output terminal, and has a gate electrode connected to the gate electrode of the third P-type transistor.

According to an embodiment, the second current output may include a third N-type transistor that is connected between the first P-type transistor and the ground, and has a gate electrode and a drain electrode connected to each other; and a fourth N-type transistor that is connected between the output terminal and the ground, and has a gate electrode connected to the gate electrode of the third N-type transistor.

An embodiment of a data driver according to the present inventive concept includes: a digital-to-analog converter that converts digital image data to an analog data signal; and an output buffer that provides the data signal to a data line connected to the display panel. The output buffer may include: a buffer circuit that outputs the data signal to an output terminal based on a first input signal provided to a first input terminal and a second input signal provided to a second input terminal; and a current supply circuit that is connected in parallel to the buffer circuit, and provides an auxiliary current to the output terminal based on the first input signal and the second input signal. The data signal may be provided to the second input terminal.

According to an embodiment, the current supply circuit includes a current source generator that is connected to the first input terminal and generates a first current provided through a first current path or a second current provided through a second current path based on the first input signal and the data signal; a first current controller that is connected between the second input terminal and the current source generator and controls the first current based on a third current generated by the first current; a second current controller that is connected between the second input terminal and the current source generator and controls the second current based on a fourth current generated by the second current; a first current output that provides a value obtained by multiplying the first current by K times (where K is a positive real number) as the auxiliary current to the output terminal; and a second current output that allows a value obtained by multiplying the second current by K times as the auxiliary current to flow from the output terminal to a ground.

An embodiment of a display device according to the present inventive concept includes: a display panel including pixels; a scan driver that supplies scan signals to the pixels through scan lines; and a data driver that includes a digital-to-analog converter for converting digital image data to an analog data signal, and an output buffer for providing the data signal to data lines connected to the display panel. The output buffer may include: a buffer circuit that outputs the data signal to an output terminal based on a first input signal provided to a first input terminal and a second input signal provided to a second input terminal; and a current supply circuit that is connected in parallel to the buffer circuit, and provides an auxiliary current to the output terminal based on the first input signal and the second input signal. The data signal may be provided to the second input terminal.

An output buffer according to embodiments of the present invention, a data driver, and a display device including the same may use a current supply circuit connected in parallel to a buffer circuit to instantaneously provide a very large auxiliary current to an output terminal when an input signal is transitioned. Accordingly, a slew rate of an output signal of the output buffer can be improved. In addition, since a dead-zone range that deteriorates output performance of the current supply circuit is reduced or minimized by the configuration and operation of current controllers, the slew rate of the output signal may be maximized even when a voltage difference between the input signal and the output signal (or a voltage difference between differential input signals) is small. Further, since the current supply circuit includes a first bias current source and a second bias current source, the slew rate of the output signal may be further improved without large power consumption.

DETAILED DESCRIPTION

Figure 1:
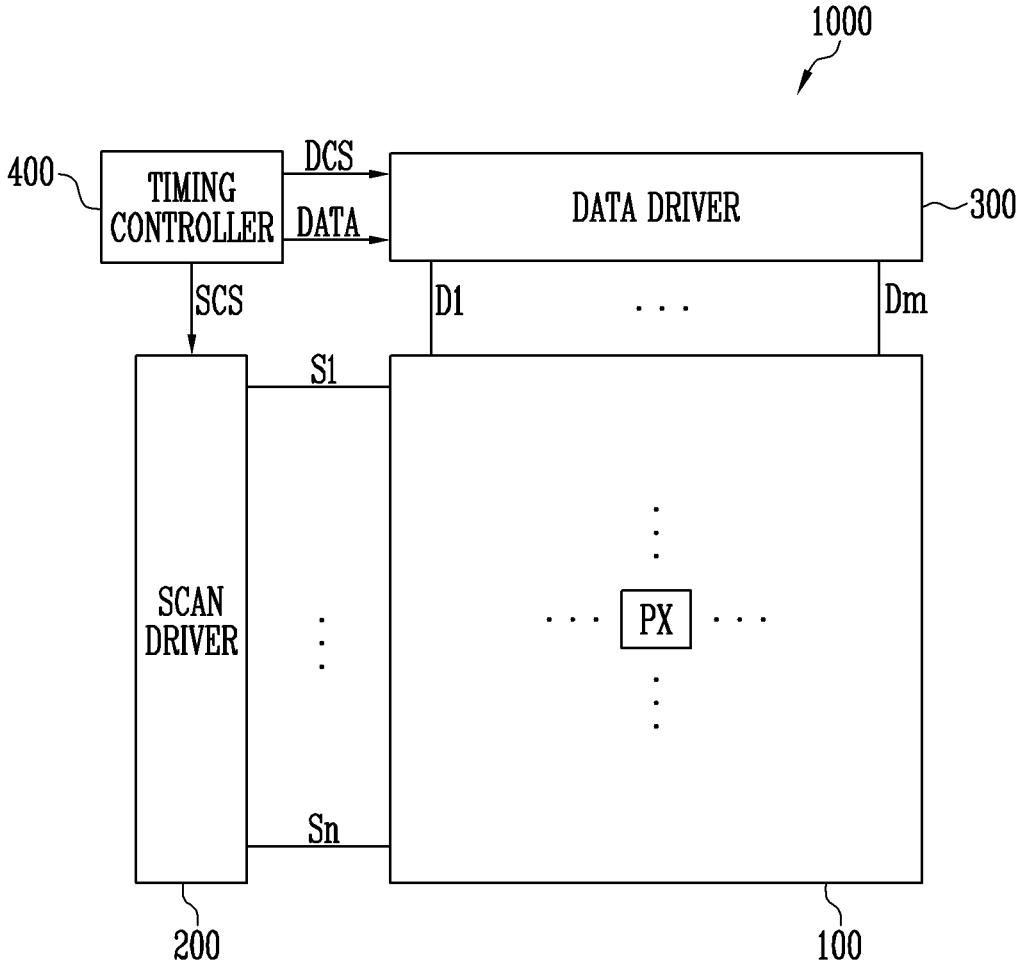
FIG. 1 is a block diagram illustrating a display device according to embodiments of the present invention.

Embodiments of the present inventive concept provide an output buffer that is connected in parallel to a buffer circuit and provides an auxiliary current to an output terminal to maximize a slew rate of an output signal.

Other embodiments of the present inventive concept provide a data driver and a display device including the output buffer.

According to the present inventive concept, driving capability of the display device driven in a high driving frequency may be improved.

Further, since the current supply circuit included in the output buffer may be provided in the form of an operational amplifier, and the current supply circuit may be connected in parallel to various types of amplifiers as well as the buffer circuit to be applied for general purpose. Accordingly, the slew rate of the output of the amplifier to which the current supply circuit is connected may be improved.

It should be understood, however, that the effect of the present invention is not limited to the effect described above, and various changes and modifications may be made without departing from the spirit and scope of the invention.

Hereinafter, embodiments of the present inventive concept will be described in further detail with reference to the accompanying drawings. Like reference numerals are used for like elements in the drawings, and redundant explanations for like elements are omitted.

FIG. 1 is a block diagram illustrating a display device according to embodiments of the present inventive concept.

Referring to FIG. 1, a display device 1000 may include a display panel 100, a scan driver 200, a data driver 300 (or a source driver), and a timing controller 400.

The display device 1000 may be implemented as a self-luminous display device including a plurality of self-luminous elements. For example, the display device 1000 may be an organic light-emitting display device including organic light-emitting elements or a display device including inorganic light-emitting elements. However, this is exemplary, and the display device 1000 may be implemented as a liquid crystal display device, a plasma display device, a quantum dot display device, or the like.

The display panel 100 includes a plurality of scan lines S1 to Sn (here n is an integer greater than 1), a plurality of data lines D1 to Dm (here m is an integer greater than 1), and a plurality of pixels PX respectively connected to the scan lines S1 To Sn and the data lines D1 to Dm. In an embodiment, the pixels PX disposed in the i-th row and j-th column (here i and j are positive integers) may be connected to a scan line S1 corresponding to the i-th pixel row and a data line Dj corresponding to the j-th pixel column.

The timing controller 400 may generate a first control signal SCS and a second control signal DCS in response to synchronization signals supplied from the outside. The first control signal SCS may be supplied to the scan driver 200, and the second control signal DCS may be supplied to the data driver 300. In addition, the timing controller 400 may rearrange the input image data supplied from the outside into image data DATA and supply it to the data driver 300.

The scan driver 200 may receive a first control signal SCS from the timing controller 400 and supply a scan signal to the scan lines S1 to Sn based on the first control signal SCS.

The data driver 300 may receive the second control signal DCS and the image data DATA from the timing controller 400. The data driver 300 may supply data signals to the data lines D1 to Dm in response to the second control signal DCS. The data signal supplied to the data lines D1 to Dm may be supplied to the pixels PX selected by the scan signal. In an embodiment, the data driver 300 may include a digital-to-analog converter that converts digital image data DATA into analog data signals, and output buffers that respectively output data signals to the data lines D1 to Dm.

In an embodiment, the display device 1000 may further include a light-emitting driver that supplies a light-emitting control signal to the pixel PX and a power supply that supplies predetermined power voltages to the pixel PX.

Figure 2:
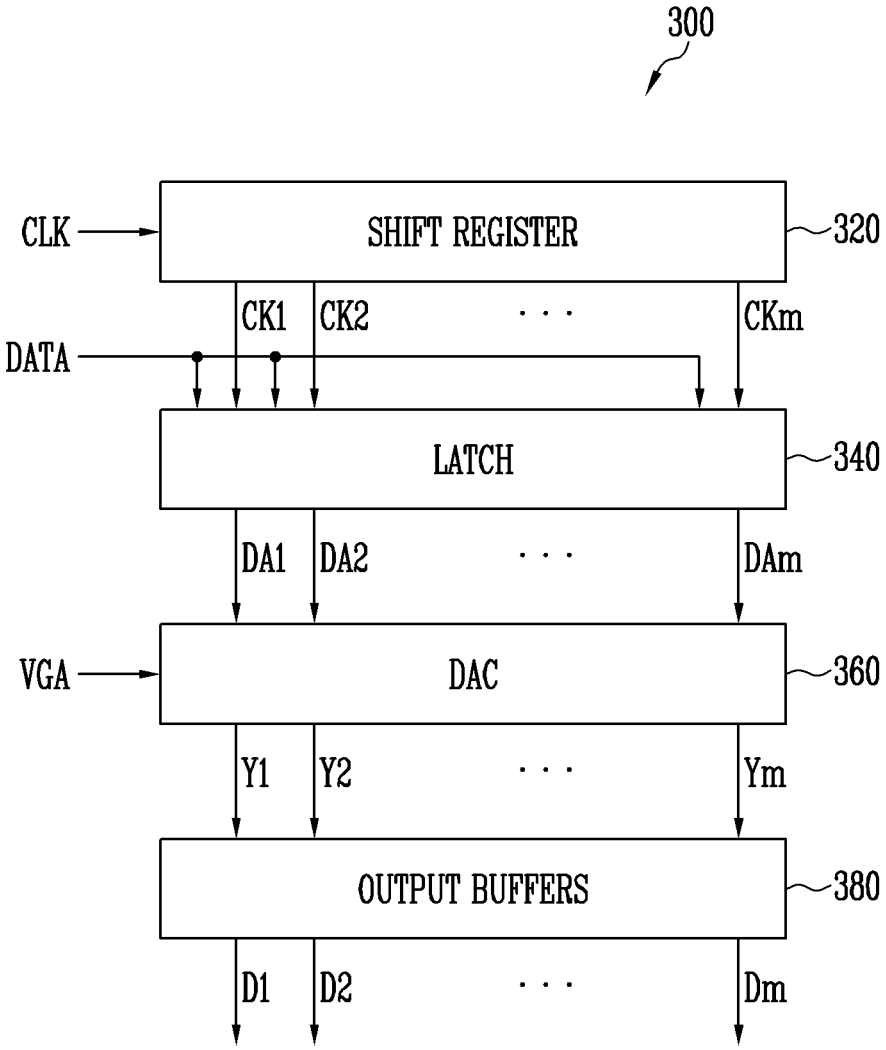
FIG. 2 is a block diagram illustrating a data driver according to embodiments of the present invention.
Figure 3:
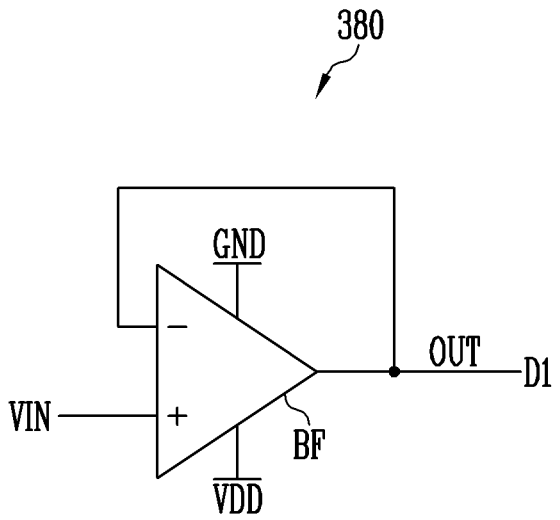
FIG. 3 is a drawing illustrating an example of an output buffer included in the data driver of FIG. 2.

FIG. 2 is a block diagram illustrating a data driver according to embodiments of the present inventive concept, and FIG. 3 is a drawing illustrating an example of an output buffer included in the data driver of FIG. 2.

Referring to FIGS. 1, 2, and 3, the data driver 300 may include a shift register 320, a latch 340, a digital-to-analog converter 360, and output buffers 380.

According to an embodiment, the data driver 300 may be mounted on the display panel 100 in a form of a driver IC. Alternatively, the data driver 300 may be integrated on the display panel 100.

The shift register 320 may sequentially activate latch clock signals CK1, CK2, . . . , CKm in synchronization with the clock signal CLK.

The latch 340 may latch the image data DATA in response to the latch clock signals CK1, CK2, . . . , CKm. In addition, the latch 340 may provide the latched image data DA1, DA2, . . . , DAm to the digital-to-analog converter 360 in response to a line latch signal.

The latch 340 has a size corresponding to the number of bits of the image data DATA. In an embodiment, the latch 340 may include m sampling latches for storing m image data DATA (here m is a natural number), respectively. Each sampling latch may have a storage capacity corresponding to the number of bits of the image data DATA, and may sequentially store digital image data signals in response to the sampling signals.

In an embodiment, the latch 340 may further include holding latches. The holding latches may simultaneously receive and store the image data DATA from the sampling latches, and may simultaneously supply the sampled image data DATA stored in the previous period to the digital-to-analog converter 360.

The digital-to-analog converter 360 may convert image data DA1, DA2, . . . , DAm into analog data signals Y1, Y2, . . . , Ym. The digital-to-analog converter 360 may receive a gamma voltage (VGA) supplied from the gamma voltage generator, and convert the image data DA1, DA2, . . . , DAm to analog data signals Y1, Y2, . . . , Ym) and output those to the output buffers 380.

The output buffers 380 may output the data signals Y1, Y2, . . . , Ym to the data lines D1, D2, . . . , Dm. For example, the output buffers 380 may be connected one-to-one to the data lines D1, D2, . . . , Dm or fan-out lines. The fan-out lines may be formed in a non-display area of the display panel 100 and may be connected between the output buffers 380 and the data lines D1, D2, . . . , Dm.

FIG. 3 shows an example of an output buffer BF connected to the first data line D1. The output buffer BF may be a buffer amplifier in a form of a voltage follower. For example, a data signal (i.e., an input signal VIN) may be supplied to a first input terminal that is a non-inverting input terminal, and an inverting input terminal and an output terminal OUT may be connected to each other. For the operation of the output buffer BF, a predetermined power voltage VDD may be supplied to the output buffer BF. The power voltage VDD may be a voltage higher than a voltage of the ground GND.

However, this is exemplary, and the output buffer BF of FIG. 3 is not limited to being applied to the data driver 300. The output buffer BF may be applied to various types of driving circuits that generate an output signal based on a differential input. For example, the output buffer BF may be applied to a driving circuit such as a regulator, a power booster, and the like.

Figure 4:
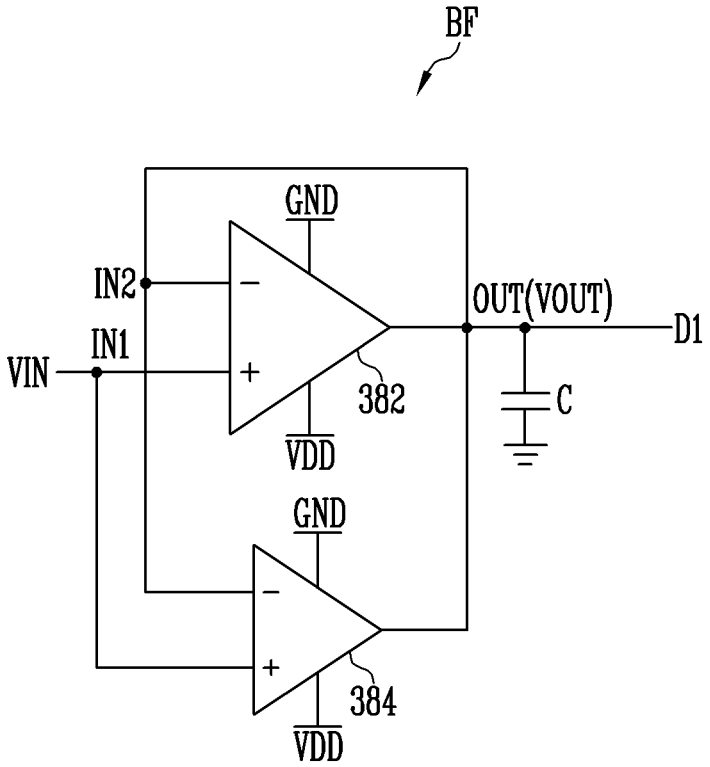
FIG. 4 is a drawing illustrating an output buffer according to embodiments of the present invention.

FIG. 4 is a drawing illustrating an output buffer according to embodiments of the present inventive concept.

Referring to FIG. 4, the output buffer BF may include a buffer circuit 382 and a current supply circuit 384.

The buffer circuit 382 may output an output signal VOUT to an output terminal OUT based on a first input signal (e.g., an input signal VIN) provided to the first input terminal IN1 and a second input signal provided to the second input terminal IN2. The first input terminal IN1 may be connected to a non-inverting input terminal of the buffer circuit 382, and the second input terminal IN2 may be connected to an inverting input terminal of the buffer circuit 382. Also, the inverting input terminal of the buffer circuit 382 may be connected to the output terminal OUT. Accordingly, the output signal VOUT may be supplied to the second input terminal IN2.

The current supply circuit 384 may have a form connected in parallel to the buffer circuit 382. In an embodiment, the current supply circuit 384 may have a type similar to a CMOS cascode amplifier. For example, the non-inverting input terminal of the current supply circuit 384 may be connected to the first input terminal IN1, and the inverting input terminal thereof may be connected to the second input terminal IN2. An output of the current supply circuit 384 may be provided to the output terminal OUT.

The current supply circuit 384 may provide an auxiliary current to the output terminal OUT based on the first input signal (e.g., the input signal VIN) and the second input signal (e.g., the output signal VOUT). The auxiliary current may be provided to the output terminal OUT to improve the slew rate of the output signal VOUT. In particular, even when a voltage difference between the first input signal and the second input signal, which is a differential input, is small, the current supply circuit 384 can quickly generate a large auxiliary current during a short period corresponding to a transition period of the output signal VOUT, thereby improving the slew rate.

Meanwhile, a capacitor C connected between the output terminal OUT and the ground GND may have an equivalent capacitance corresponding to a load of the data line D1 (or the first data line), and may be charged with a voltage output to the data line D1.

Figure 5:
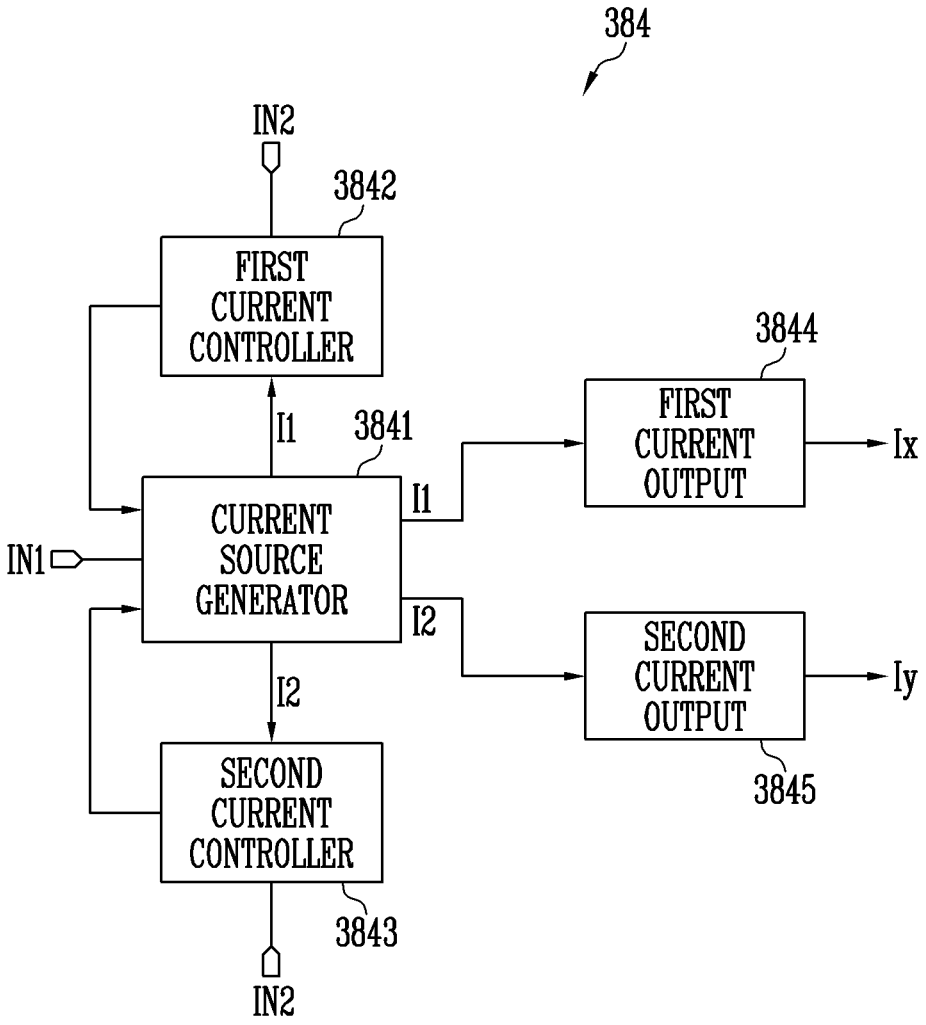
FIG. 5 is a block diagram illustrating a current supply circuit included in the output buffer of FIG. 4.
Figure 6:
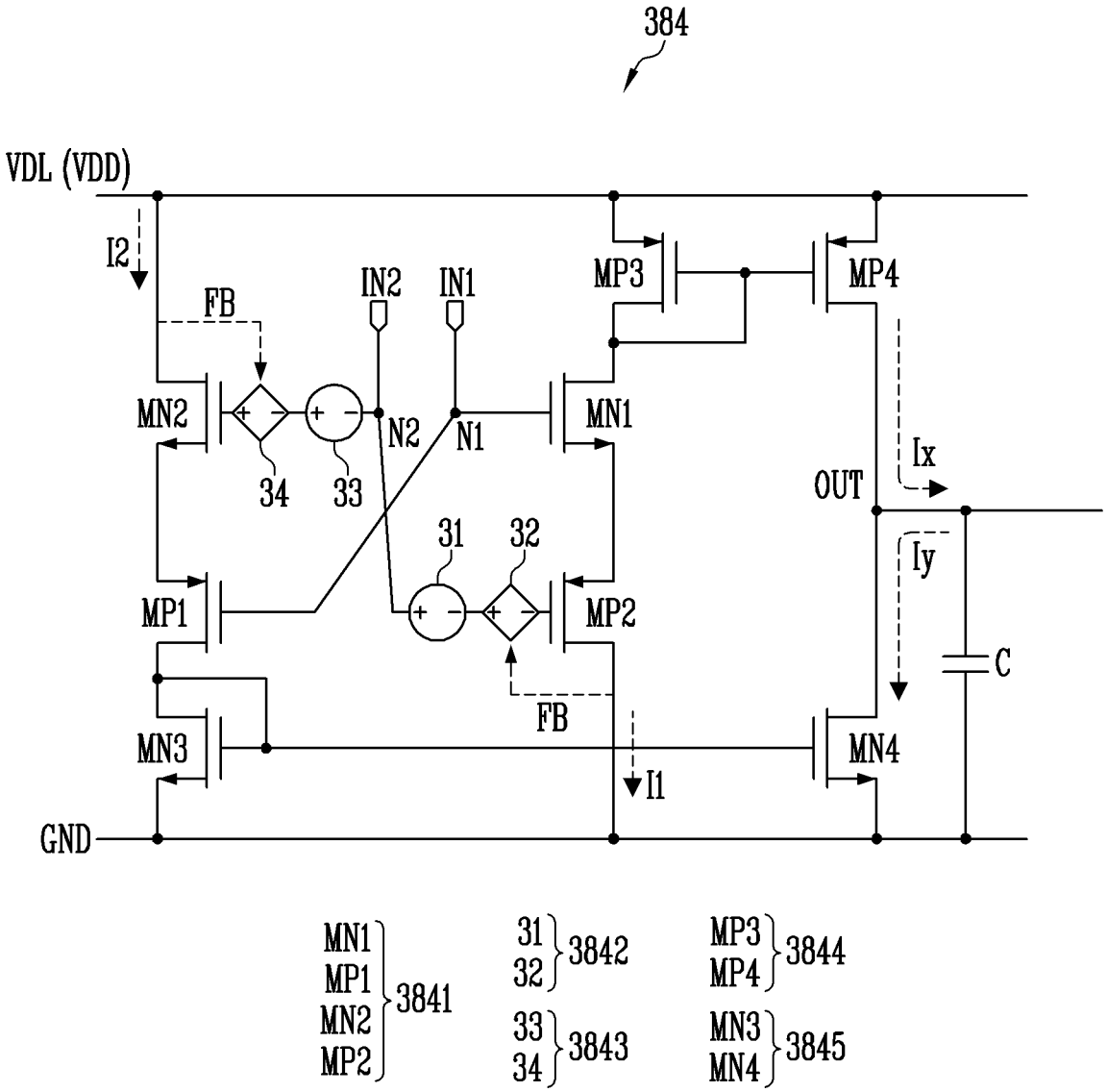
FIG. 6 is a circuit diagram illustrating an example of the current supply circuit of FIG. 5.

FIG. 5 is a block diagram illustrating a current supply circuit included in the output buffer of FIG. 4, and FIG. 6 is a circuit diagram illustrating an example of the current supply circuit of FIG. 5.

Referring to FIGS. 4, 5, and 6, the current supply circuit 384 may include a current source generator 3841, a first current controller 3842, a second current controller 3843, a first current output 3844, and a second current output 3845. The current supply circuit 384 may be connected between a power line VDL (or a power rail) supplying the power voltage VDD and a ground GND (or a ground rail).

The current source generator 3841 may be connected to the first input terminal IN1. The current source generator 3841 may generate a first current I1 provided through a first current path and a second current I2 provided through a second current path based on a first input signal supplied to the first input terminal IN1 and a second input signal supplied to the second input terminal IN2. For example, the current source generator 3841 may have a structure similar to the CMOS cascode amplifier, and may generate the first current I1 and/or the second current I2 in the form of an exponential function.

Figure 10:
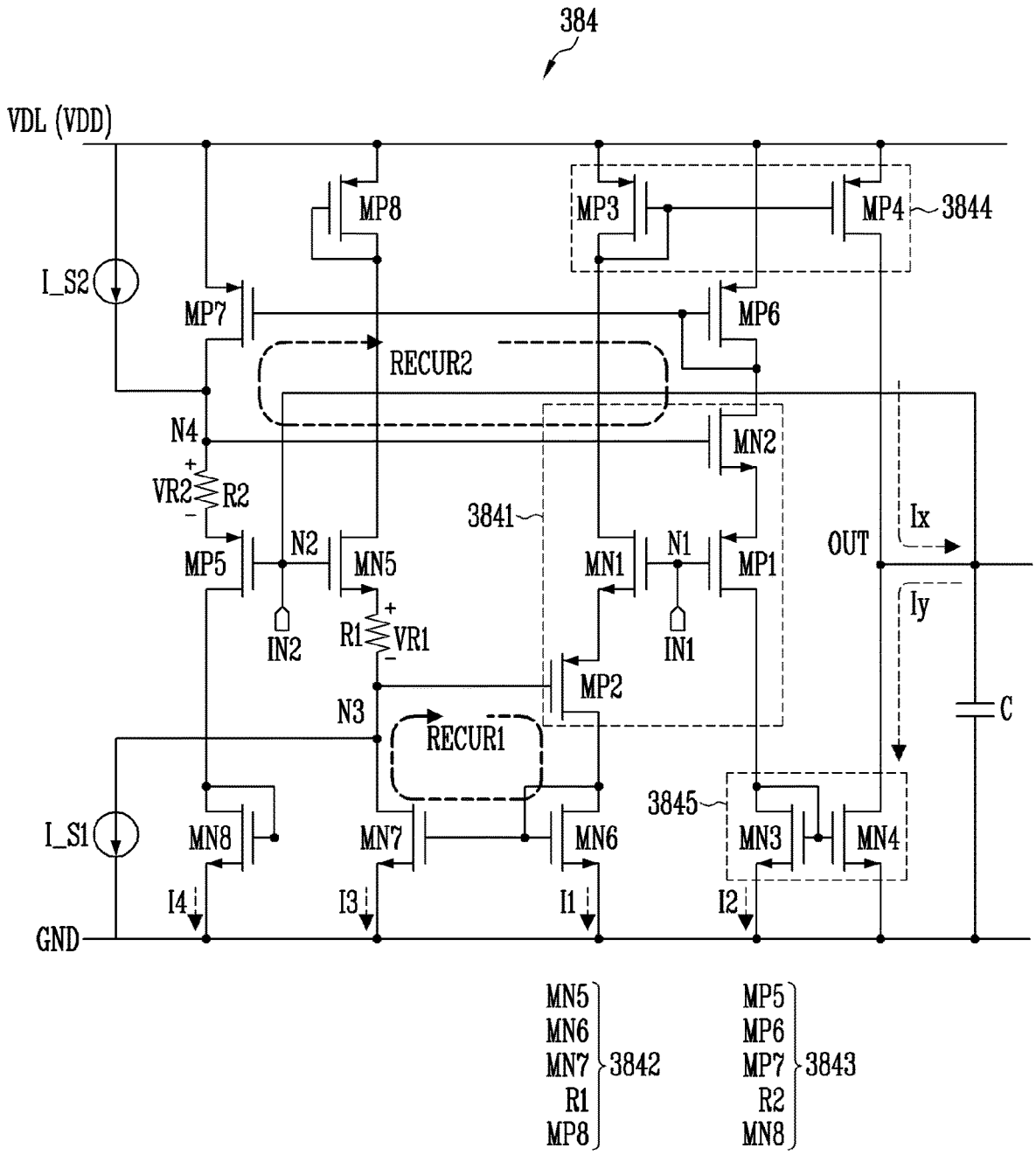
FIG. 10 is a circuit diagram illustrating an example of the current supply circuit of FIG. 5.

Meanwhile, the current supply circuit 384 of FIG. 6 may be understood as an equivalent circuit of the current supply circuit 384 of FIG. 10.

The first current I1 may be provided to the first current output 3844 and the first current controller 3842. The second current I2 may be provided to the second current output 3845 and the second current controller 3843.

In an embodiment, the current source generator 3841 may include a first P-type transistor MP1, a first N-type transistor MN1, a second P-type transistor MP2, and a second N-type transistor MN2.

The first P-type transistor MP1 may be connected between the power line VDL and the ground GND. The first P-type transistor MP1 may include a gate electrode connected to the first node N1. The first node N1 may be a node substantially the same as the first input terminal IN1.

The first N-type transistor MN1 may be connected in parallel to the first P-type transistor MP1 between the power line VDL and the ground GND. The first N-type transistor MN1 may include a gate electrode connected to the first node N1.

The second P-type transistor MP2 may be connected between the first N-type transistor MN1 and the ground GND to form a first current path. The second P-type transistor MP2 may include a gate electrode connected to the first current controller 3842.

The second N-type transistor MN2 may be connected between the power line VDL and the first P-type transistor MP1 to form a second current path. The second N-type transistor MN2 may include a gate electrode connected to the second current controller 3843.

When both the first N-type transistor MN1 and the second P-type transistor MP2 connected in series to each other are turned on, the first current path may be formed. Since the first N-type transistor MN1 and the second P-type transistor MP2 are of different types, the voltage of the first node N1 and the voltage of the second node N2 must be different. For example, when the first current controller 3842 does not exist and the voltage difference between the first input signal and the second input signal is very small, at least one of the first N-type transistor MN1 and the second P-type transistor MP2 may be not turned on, and the first current I1 may be not generated. That is, when the voltage difference between the first input signal and the second input signal (e.g., the voltage difference between the voltage of the first node N1 and the voltage of the second node N2) is less than or equal to a predetermined threshold, the first current I1 may be not generated.

Similarly, when both the first P-type transistor MP1 and the second N-type transistor MN2 connected in series to each other are turned on based on the voltage of the first node N1 and the voltage of the second node N2, which are different from each other, a second current path may be formed.

As described above, even when the voltage difference between the first input signal and the second input signal is very small, the current supply circuit 384 may include the first current controller 3842 and the second current controller 3843 to generate the first current I1 and the second current I2.

In an embodiment, the first current controller 3842 may be connected between the second input terminal IN2 and the current source generator 3841. The first current controller 3842 may control the first current I1 based on the third current generated by the first current I1. For example, the first current controller 3842 may function as a first constant voltage source 31 and a first variable voltage source 32 connected between the second input terminal IN2 (or the second node N2) and a gate electrode of the second P-type transistor MP2. Accordingly, the voltage difference between the gate voltage (e.g., the voltage of the first node N1) of the first N-type transistor MN1 and the gate voltage of the second P-type transistor MP2 may be greater than a predetermined first threshold. For example, a size of the first threshold may be Vth.

For example, assuming that the absolute value of the threshold voltage of the first N-type transistor MN1 and the threshold voltage of the second P-type transistor MP2 are the same as Vth, the voltage difference between the voltage of the second node N2 and the gate voltage of the second P-type transistor MP2 may be set to a value close to 2Vth by the first current controller 3842 serving as the first constant voltage source 31 and the first variable voltage source 32. Accordingly, even when the voltage difference between the first input signal and the second input signal is small, both the first N-type transistor MN1 and the second P-type transistor MP2 are turned on to generate the first current I1. According to an embodiment, the voltage of the first constant voltage source 31 may be similar to the threshold voltage Vth of the second P-type transistor MP2.

In an embodiment, the voltage of the first variable voltage source 32 may vary depending on the size of the first current I1. For example, the voltage of the first variable voltage source 32 and the first current I1 may reach a target value by recursive feedback based on the first current I1. For example, the voltage of the first variable voltage source 32 may vary within a range between 0V and the threshold voltage Vth of the second P-type transistor MP2.

In an embodiment, the second current controller 3843 may be connected between the second input terminal IN2 and the current source generator 3841. The second current controller 3843 may control the second current I2 based on a fourth current generated by the second current I2. For example, the second current controller 3843 may function as a second constant voltage source 33 and a second variable voltage source 34 connected between the second input terminal IN2 (or the second node N2) and the gate electrode of the second N-type transistor MN2. Accordingly, the voltage difference between the gate voltage (e.g., the voltage of the first node N1) of the first P-type transistor MP1 and the gate voltage of the second N-type transistor MN2 may be greater than a predetermined second threshold. Accordingly, even when the voltage difference between the first input signal and the second input is small, both the first P-type transistor MP1 and the second N-type transistor MN2 are turned on to generate the second current I2.

In an embodiment, the voltage of the second variable voltage source 34 may vary depending on the size of the second current I2. For example, the voltage of the second variable voltage source 34 and the second current I2 may reach a target value by recursive feedback based on the second current I2.

Since the first and second current controllers 3842 and 3843 are symmetrical to each other, duplicate descriptions will be omitted.

The first current output 3844 may provide a first auxiliary current Ix that multiplies the first current I1 by K times (herein K is a real number of 1 or more) to the output terminal OUT. In an embodiment, the first current output 3844 may include a third P-type transistor MP3 and a fourth P-type transistor MP4.

The third P-type transistor MP3 may be connected between the power line VDL and the first N-type transistor MN1. The third P-type transistor MP3 may include a gate electrode and a drain electrode connected to each other.

The fourth P-type transistor MP4 may be connected between the power line VDL and the output terminal OUT. The fourth P-type transistor MP4 may include a gate electrode connected to the gate electrode of the third P-type transistor MP3.

The third P-type transistor MP3 and the fourth P-type transistor MP4 may be current mirrors forming a current ratio of 1:K. For example, the first auxiliary current Ix flowing through the fourth P-type transistor MP4 may be copied from the first current I1 and may be K times the first current I1 (e.g., Ix=K*I1). Accordingly, an aspect ratio of the third P-type transistor MP3 and an aspect ratio of the fourth P-type transistor MP4 may be different. Alternatively, the third P-type transistor MP3 may include a plurality of P-type transistors connected in series to each other to form a current ratio of 1:K.

The first auxiliary current Ix may affect the slew rate of the rising edge of the output signal VOUT.

The second current output 3845 may provide a second auxiliary current Iy that multiples the second current I2 by K times to the output terminal OUT. In an embodiment, the second current output 3845 may include a third N-type transistor MN3 and a fourth N-type transistor MN4.

The third N-type transistor MN3 may be connected between the first P-type transistor MP1 and the ground GND. The third N-type transistor MN3 may include a gate electrode and a drain electrode connected to each other.

The fourth N-type transistor MN4 may be connected between the output terminal OUT and the ground GND. The fourth N-type transistor MN4 may include a gate electrode connected to the gate electrode of the third N-type transistor MN3.

The third N-type transistor MN3 and the fourth N-type transistor MN4 may be current mirrors forming a current ratio of 1:K. For example, the second auxiliary current Iy flowing through the fourth N-type transistor MN4 may be copied from the second current I2 and may be K times the second current I2 (e.g., Iy=K*I2).

The second auxiliary current Iy may affect the slew rate of a falling edge of the output signal VOUT.

Since the first current output 3844 and the second current output 3845 are symmetrical to each other, they may be driven in substantially the same manner.

Figure 7:
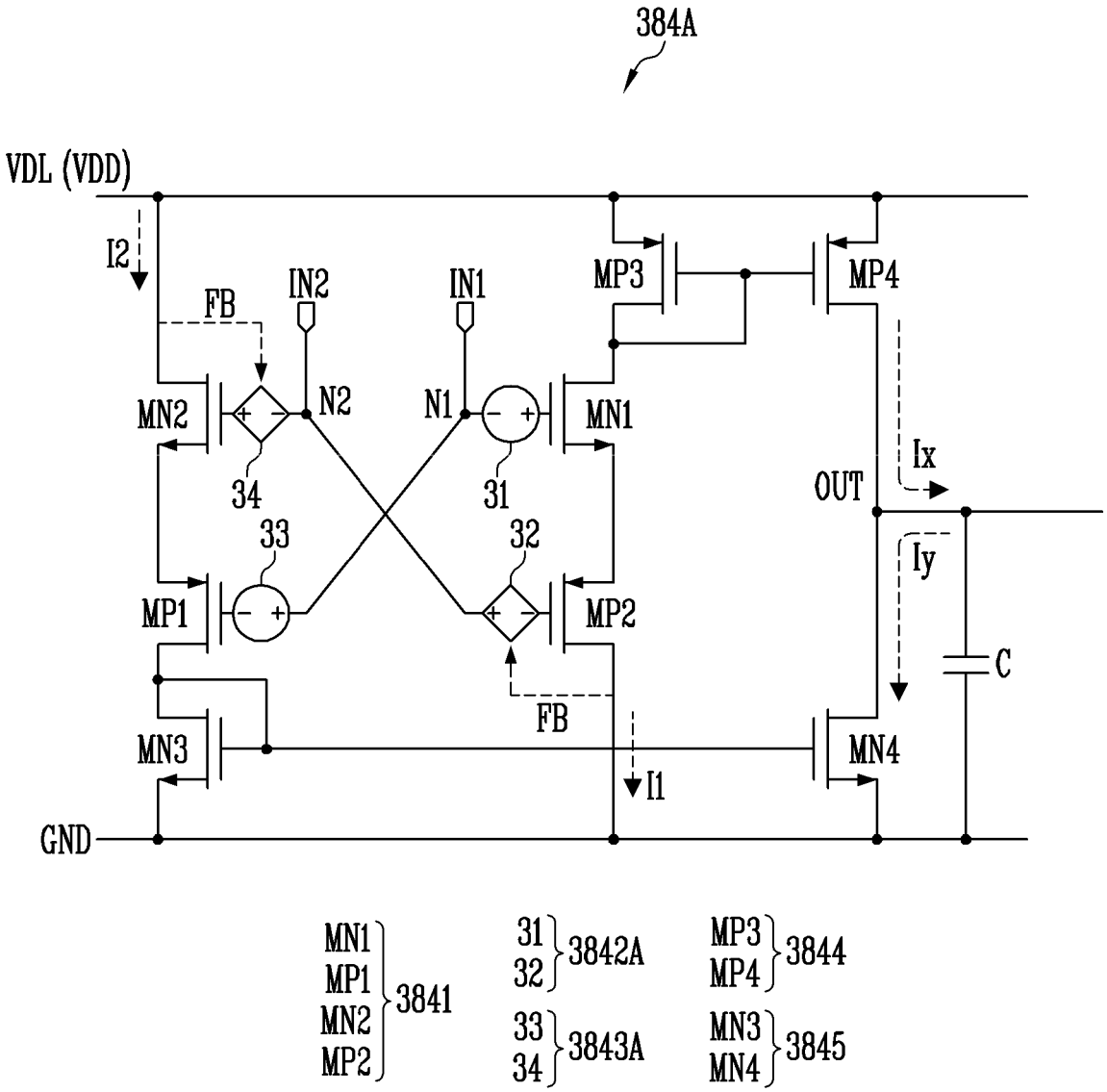
FIG. 7 is a circuit diagram illustrating an example of an equivalent circuit of the current supply circuit of FIG. 6.

FIG. 7 is a circuit diagram illustrating an example of an equivalent circuit of the current supply circuit of FIG. 6.

Referring to FIG. 7, the current supply circuit 384A may include a current source generator 3841, a first current controller 3842A, a second current controller 3843A, a first current output 3844, and a second current output 3845.

The first current controller 3842A may function as the first constant voltage source 31 and the first variable voltage source 32. For example, the first constant voltage source 31 may be connected between the gate electrode of the first N-type transistor MN1 and the first node N1, and the first variable voltage source 32 may be connected between the second node N2 and the gate electrodes of the second P-type transistor MP2. That is, the first current controller 3842A of FIG. 7 may be an equivalent circuit of the first current controller 3842 of FIG. 6.

For example, when each of the first constant voltage source 31 and the first variable voltage source 32 supplies a voltage of the threshold voltage Vth, the gate voltage of the first N-type transistor MN1 may correspond to a sum (e.g., VN1+Vth) of the voltage of the first node N1 and the threshold voltage Vth, and the gate voltage of the second P-type transistor MP2 may correspond to a difference (e.g., VN2−Vth) of the voltage of the second node N2 and the threshold voltage Vth. Accordingly, a voltage difference between the gate voltage of the first N-type transistor MN1 and the gate voltage of the second P-type transistor MP2 may be VN1−VN2+2Vth.

In the first current controller 3842 of FIG. 6 under the same conditions, the gate voltage of the first N-type transistor MN1 may be a voltage (e.g., VN1) of the first node N1, and the gate voltage of the second P-type transistor MP2 may be VN2−2Vth. Accordingly, in FIG. 7, a voltage difference between the gate voltage of the first N-type transistor MN1 and the gate voltage of the second P-type transistor MP2 may be VN1−VN2+2Vth.

Similarly, the second current controller 3843A may function as the second constant voltage source 33 and the second variable voltage source 34. For example, the second constant voltage source 33 may be connected between the first node N1 and the gate electrode of the first P-type transistor MP1, and the second variable voltage source 34 may be connected between the gate electrode of the second N-type transistor MN2 and the second node N2. As described with reference to the first current controller 3842A, the second current controller 3843A and the second current controller 3843 of FIG. 6 may be equivalent circuits.

Accordingly, the current supply circuit 384A may be a circuit equivalent to the current supply circuit 384 of FIGS. 6 and 10, and may operate substantially the same.

Figure 8:
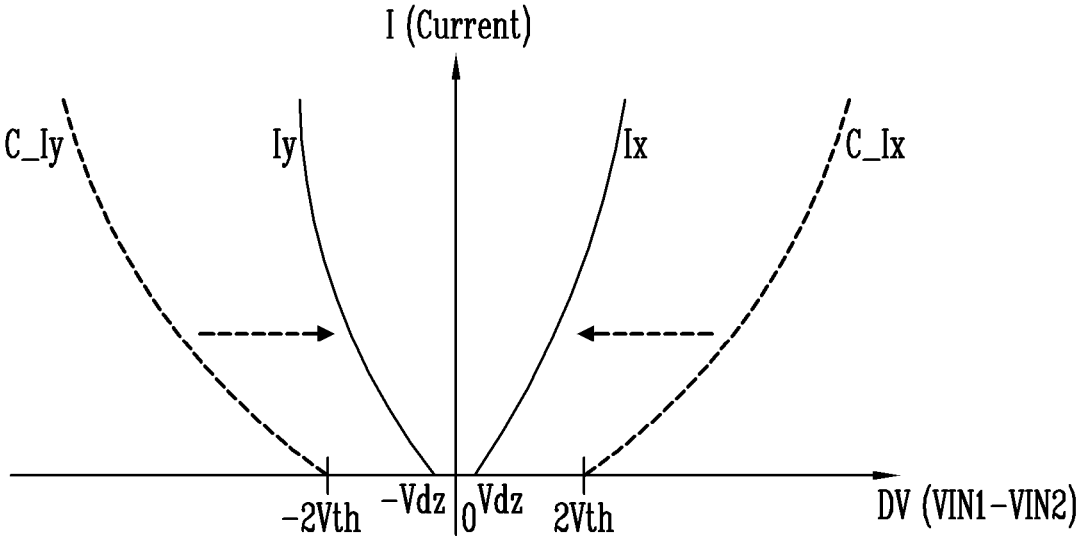
FIG. 8 is a drawing illustrating an example of a relationship between a voltage difference of input signals supplied to the current supply circuit of FIG. 5 and an output auxiliary current.

FIG. 8 is a drawing illustrating an example of a relationship between a voltage difference of input signals supplied to the current supply circuit of FIG. 5 and an output auxiliary current.

Referring to FIGS. 5, 6, and 8, the auxiliary currents C_Ix, Ix, C_Iy, and Iy may vary depending on the voltage difference DV between the first input signal VIN1 and the second input signal VIN2. In an embodiment, the second input signal VIN2 may be an output signal (VOUT in FIG. 4).

Hereinafter, description will be made on the premise that the absolute values of the threshold voltages of all transistors included in the current source generator 3813 are the same as Vth. Current curves of C_Ix and C_Iy are auxiliary currents output from a conventional current supply circuit that does not include the first and second current controllers 3842 and 3843. Current curves of Ix and Iy are auxiliary currents output from the current supply circuit 384 according to embodiments of the present inventive concept. The auxiliary currents C_Ix, Ix, C_Iy, and Iy may change in the form of an exponential function within a predetermined range.

In a conventional current supply circuit, when the absolute value of the voltage difference DV is 2 Vth or less, at least one of the first N-type transistor MN1 and the second P-type transistor MP2 may be not turned on, and the first current path (e.g., the first current I1) may be not generated. In addition, when the absolute value of the voltage difference DV is 2 Vth or less, at least one of the first P-type transistor MP1 and the second N-type transistor MN2 may be not turned on, and the second current path (e.g., the second current I2) may be not generated. When the absolute value of the voltage difference DV is greater than 2Vth, the first current I1 or the second current I2 may be generated, and one of the auxiliary currents C_Ix and C_Iy may be selectively generated.

In other words, in the conventional current supply circuit, the auxiliary currents C_Ix and C_Iy may be not generated and the slew rate of the output signal VOUT decrease in a range (hereinafter referred to as a dead zone) in which the absolute value of the voltage difference DV of the input signals is 2Vth. For example, when the power voltage VDD is low or the input step is low, the voltage difference DV between the input signals is small, and thus the effect of increasing the slew rate by the current supply circuit is insignificant.

The current supply circuit 384 according to embodiments of the present inventive concept may minimize the dead-zone by using the first and second current controllers 3842 and 3843. For example, the first auxiliary current Ix may be generated in the first dead-zone voltage Vdz in which the voltage difference DV between the first input signal VIN1 and the second input signal VIN2 is less than 2Vth. In addition, the second auxiliary current Iy may be generated in the second dead-zone voltage −Vdz in which the voltage difference DV between the first input signal VIN1 and the second input signal VIN2 is greater than −2Vth.

Thus, even when the voltage difference DV between the first input signal VIN1 and the second input signal VIN2 is less than 2Vth, the auxiliary currents Ix and Iy may increase quickly and significantly. Accordingly, an improvement in the slew rate of the output signal VOUT can be maximized.

Figure 9A:
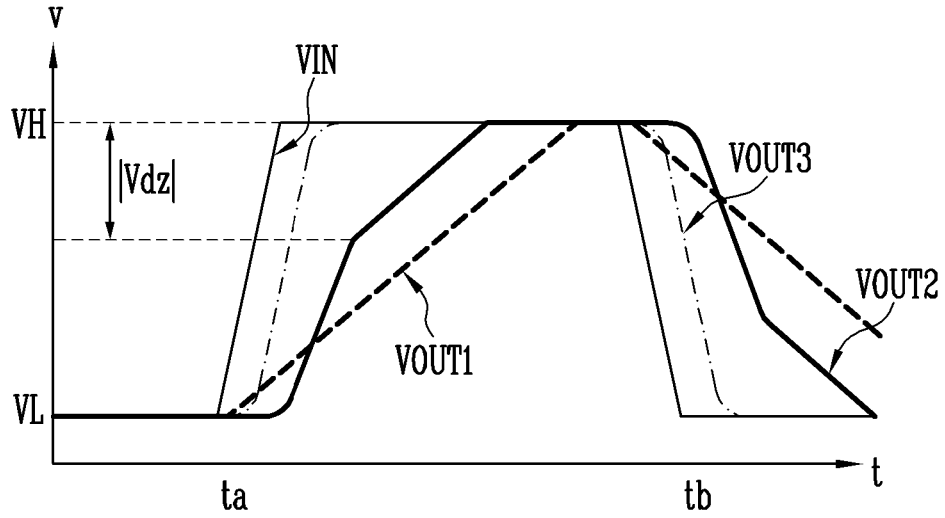
FIG. 9A is a drawing illustrating a relationship between an input signal and an output signal of an output buffer.
Figure 9B:
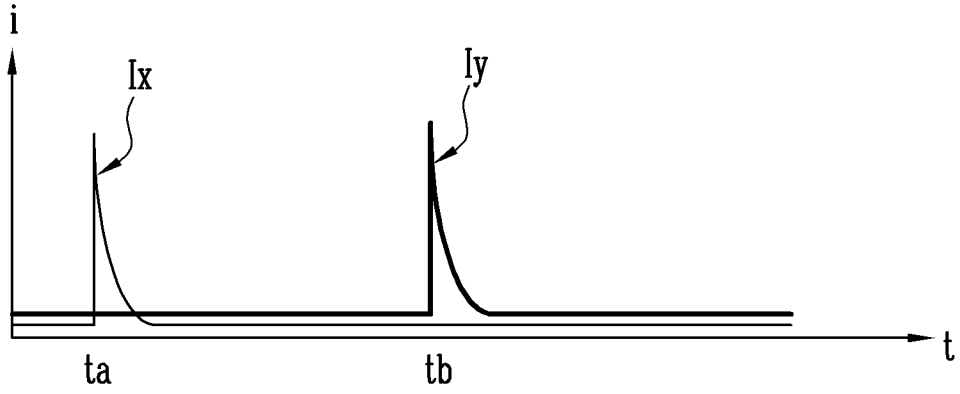
FIG. 9B is a drawing illustrating an example of output of an auxiliary current in a current supply circuit corresponding to the output signal of FIG. 9A.

FIG. 9A is a drawing illustrating a relationship between an input signal and an output signal of an output buffer, and FIG. 9B is a drawing illustrating an example of output of an auxiliary current in a current supply circuit corresponding to the output signal of FIG. 9A.

Referring to FIGS. 4, 5, 6, 8, 9A, and 9B, the slew rate of the output signal may increase by the first and second current controllers 3842 and 3843.

As shown in FIG. 9A, the input signal VIN supplied to the first input terminal IN1 may transition from the low level VL to the high level VH at a first time point ta, and may transition from the high level VH to the low level VL at a second time point tb. When the output buffer BF does not include the current supply circuit 384, the output signal VOUT may change into the same shape as the first voltage waveform VOUT1 due to linearity of the buffer circuit 382.

When the output buffer BF includes the current supply circuit 384, the output signal VOUT may have shapes of a second voltage waveform VOUT2 or a third voltage waveform VOUT3. The second voltage waveform VOUT2 and the third voltage waveform VOUT3 may be determined depending on the dead-zone range |Vdz| set in the current supply circuit 384. For example, as the dead-zone range |Vdz| is set smaller, the output signal VOUT may be output in a shape close to the third voltage waveform VOUT3.

When the voltage difference between the input signal VIN and the output signal VOUT (i.e., the voltage difference DV between the first input signal VIN1 and the second input signal VIN2) is included in the dead-zone range |Vdz|, the first and second auxiliary currents Ix and Iy are not generated, thereby reducing a voltage change rate.

FIG. 9B shows first and second auxiliary currents Ix and Iy generated by the current supply circuit 384. The first auxiliary current Ix may greatly increase at the first time point ta, and a rising edge of the third voltage waveform VOUT3 may be implemented in response thereto. In addition, the second auxiliary current Iy may greatly increase at the second time point tb, and a falling edge of the third voltage waveform VOUT3 may be implemented in response thereto.

The current supply circuit 384 may consume only a very small current during periods other than the first time point ta and the second time point tb when the output signal VOUT is transitioned.

FIG. 10 is a circuit diagram illustrating an example of the current supply circuit of FIG. 5.

The first current controller 3842 and the second current controller 3843 may have a mutually symmetric configuration, and the first current output 3844 and the second current output 3845 may have a mutually symmetrical configuration. Accordingly, the present inventive concept will be described focusing on the configuration and operation of the first N-type transistor MN1 and the second P-type transistor MP2 of the current source generator 3841, the first current controller 3842, and the first current output 3844 generating the first auxiliary current Ix. Since the driving for generating the second auxiliary current Iy is substantially the same as the driving for generating the first auxiliary current Ix, a description thereof will be omitted.

In FIG. 10, the same reference numerals are used for constituent elements described with reference to FIG. 6, and redundant descriptions of these constituent elements will be omitted. For example, redundant descriptions of the current source generator 3841, the first current output 3844, and the second current output 3845 will be omitted.

Referring to FIGS. 5, 6, and 10, the current supply circuit 384 may include a current source generator 3841, a first current controller 3842, a second current controller 3843, and a first current output 3844, and a second current output 3845.

In an embodiment, the first current controller 3842 may include a fifth N-type transistor MN5, a sixth N-type transistor MN6, a seventh N-type transistor MN7, and a first resistor R1. The first current controller 3842 may further include an eighth P-type transistor MP8. The first current controller 3842 may control a voltage difference between the gate voltage of the first N-type transistor MN1 and the gate voltage of the second P-type transistor MP2 to be greater than a preset threshold. For example, the first current controller 3842 may determine (or adjust) the gate voltage of the second P-type transistor MP2.

The fifth N-type transistor MN5 may be connected between the power line VDL and the ground GND. The fifth N-type transistor MN5 may include a gate electrode connected to the second node N2. The fifth N-type transistor MN5 may be turned on based on the second input signal (e.g., the output signal VOUT of FIG. 4).

The sixth N-type transistor MN6 may be connected between the second P-type transistor MP2 and the ground GND. The sixth N-type transistor MN6 may include a gate electrode and a drain electrode connected to each other.

The seventh N-type transistor MN7 may be connected between the third node N3 and the ground GND. The gate electrode of the seventh N-type transistor MN7 may be connected to the gate electrode of the sixth N-type transistor MN6.

The sixth N-type transistor MN6 and the seventh N-type transistor MN7 may be current mirrors forming a current ratio of b:1 (here b is a real number of 1 or more). For example, the third current I3 flowing through the seventh N-type transistor MN7 may be copied from the first current I1 and may be 1/b times the first current I1 (e.g., I3=I1/b). The third current I3 may flow from the power line VDL to the ground GND through the fifth N-type transistor MN5, the first resistor R1, and the seventh N-type transistor MN7.

The first resistor R1 may be connected between the fifth N-type transistor MN5 and the third node N3. A first resistance voltage VR1 applied to both ends of the first resistor R1 may correspond to a voltage difference between the source voltage of the fifth N-type transistor MN5 and the voltage of the third node N3. The first resistance voltage VR1 may change depending on a change in the source voltage of the fifth N-type transistor MN5 and/or the voltage of the third node N3.

Meanwhile, the voltage at the third node N3 may be determined based on the third current I3, the first resistor R1, and the first resistance voltage VR1. In addition, the gate voltage of the second P-type transistor MP2 may be adjusted by the voltage change of the third node N3, so that the first current I1 and the third current I3 copied from the first current I1 may be changed again. As described above, the first current I1 and the first auxiliary current Ix can be increased very quickly within a short time due to the recursive feedback (e.g., RECUR1 in FIG. 10) of the first current I1 based on the second P-type transistor MP2, the sixth N-type transistor MN6, the seventh N-type transistor MN7, and the first resistor R1. In addition, the voltage change of the third node N3 due to the recursive feedback RECUR1 of the first current I1 may be interpreted as being substantially the same as the operation and configuration of the first variable voltage source 32 of FIG. 6.

When the fifth N-type transistor MN5 is turned on together with the operation of the first variable voltage source 32, the second P-type transistor MP2 may be turned on based on the source voltage thereof. When the second P-type transistor MP2 is turned on, the source voltage of the first N-type transistor MN1 may decrease. Accordingly, the size of the gate-source voltage of the first N-type transistor MN1 may be greater than the threshold voltage Vth, and the threshold voltage Vth of the first N-type transistor MN1 may be canceled by turning on the fifth N-type transistor MN5. That is, the operation of the fifth N-type transistor MN5 may be interpreted as being substantially the same as the first constant voltage source 31 of FIG. 6.

The eighth P-type transistor MP8 may be connected between the power line VDL and the fifth N-type transistor MN5. The eighth P-type transistor MP8 may include a gate electrode and a drain electrode connected to each other. For example, the eighth P-type transistor MP8 may be diode-connected. The eighth P-type transistor MP8 may prevent a current from generating in a reverse direction in a current path through which the third current I3 flows.

The second current controller 3843 may control the voltage difference between the gate voltage of the first P-type transistor MP1 and the gate voltage of the second N-type transistor MN2 to be greater than a preset threshold. For example, the second current controller 3843 may determine (or adjust) the gate voltage of the second N-type transistor MN2.

In an embodiment, the second current controller 3843 may include a fifth P-type transistor MP5, a sixth P-type transistor MP6, a seventh P-type transistor MP7, and a second resistor R2. The second current controller 3843 may further include an eighth N-type transistor MN8.

The fifth P-type transistor MP5 may be connected in parallel to the fifth N-type transistor MN5 between the power line VDL and the ground GND. The fifth P-type transistor MP5 may include a gate electrode connected to the second node N2. The fifth P-type transistor MP5 may be turned on based on the second input signal (e.g., the output signal VOUT of FIG. 4). The second node N2 and the output terminal OUT may be a common node.

The sixth P-type transistor MP6 may be connected between the power line VDL and the second N-type transistor MN2. The sixth P-type transistor MP6 may include a gate electrode and a drain electrode connected to each other.

The seventh P-type transistor MP7 may be connected between the power line VDL and the fourth node N4. The gate electrode of the seventh P-type transistor MP7 may be connected to the gate electrode of the sixth P-type transistor MP6.

The sixth P-type transistor MP6 and the seventh P-type transistor MP7 may be current mirrors forming a current ratio of b:1. For example, the fourth current I4 flowing through the seventh P-type transistor MP7 may be copied from the second current I2 and may be 1/b times the second current I2 (e.g., I4=I2/b). The fourth current I4 may flow from the power line VDL to the ground GND through the seventh P-type transistor MP7, the second resistor R2, and the fifth P-type transistor MP5.

The second resistor R2 may be connected between the fourth node N4 and the fifth P-type transistor MP5. The second resistance voltage VR2 applied to both ends of the second resistor R2 may correspond to a voltage difference between the voltage of the fourth node N4 and the source voltage of the fifth P-type transistor MP5. The second resistance voltage VR2 may change depending on a change in the source voltage of the fifth P-type transistor MP5 and/or the voltage of the fourth node N4.

Meanwhile, a voltage at the fourth node N4 may be determined based on the fourth current I4, the second resistor R2, and the second resistance voltage VR2. The second current I2 may be increased very quickly within a short time due to the recursive feedback (e.g., RECUR2 in FIG. 10) of the second current I2 based on the second N-type transistor MN2, the sixth P-type transistor MP6, the seventh P-type transistor MP7, and the second resistor R2.

Similar to the above description, the voltage change of the fourth node N4 due to the recursive feedback RECUR2 of the second current I2 may be interpreted as being substantially the same as the operation and configuration of the second variable voltage source 34 of FIG. 6. The operation of the fifth P-type transistor MP5 may be interpreted as being substantially the same as the second constant voltage source 33 of FIG. 6.

The eighth N-type transistor MN8 may be connected between the fifth P-type transistor MP5 and the ground GND. The eighth N-type transistor MN8 may include a gate electrode and a drain electrode connected to each other. For example, the eighth N-type transistor MN8 may be diode-connected. The eighth N-type transistor MN8 may prevent a current from generating in a reverse direction in a current path through which the fourth current I4 flows.

In an embodiment, the current supply circuit 384 may further include a first bias current source I_S1 and a second bias current source I_S2. The first bias current source I_S1 and the second bias current source I_S2 may be a current source that supply a quiescent current in a standby state (e.g., a state in which the input signal and the output signal are static) of the current supply circuit 384, and each thereof can supply a minute current of about 30 nA. In addition, the minute standby current does not affect the first auxiliary current Ix or the second auxiliary current Iy.

The first bias current source I_S1 may be connected between the third node N3 and the ground GND. The first standby current generated by the first bias current source I_S1 may be supplied as a bias current to the fifth N-type transistor MN5. Accordingly, when starting dynamic driving to generate the first auxiliary current Ix, which is a dynamic current, the fifth N-type transistor MN5 may be quickly turned on by the first standby current.

The second bias current source I_S2 may be connected between the power line VDL and the fourth node N4. The second standby current generated by the second bias current source I_S2 may be supplied as a bias current to the fifth P-type transistor MP5. Accordingly, when starting dynamic driving to generate the second auxiliary current Iy, which is a dynamic current, the fifth P-type transistor MP5 may be quickly turned on by the second standby current.

As described above, the slew rate of the output signal VOUT may be further improved without large power consumption due to the first bias current source I_S1 and the second bias current source I_S2.

Figure 11A:
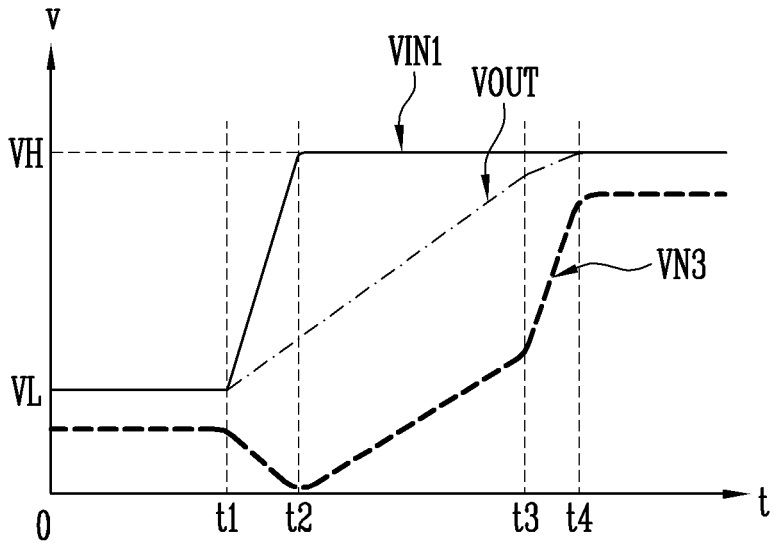
FIGS. 11A, 11B, and 11C are timing diagrams illustrating examples of waveforms of main signals generated in the current supply circuit of FIG. 10.
Figure 11B:
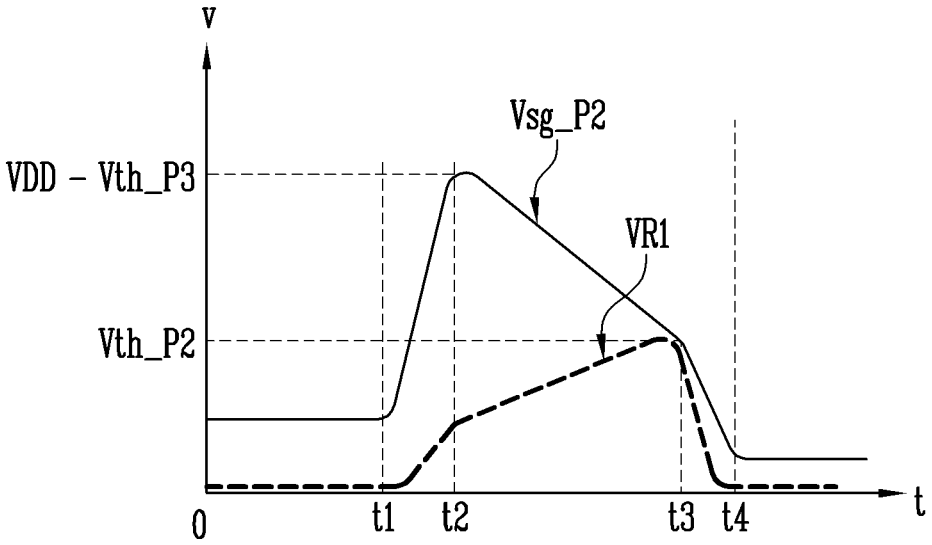
Figure 11C:
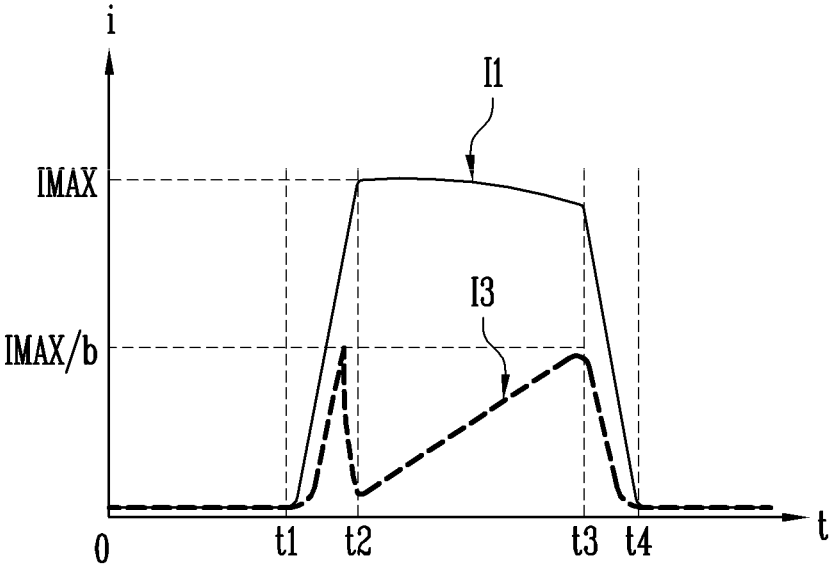

FIG. 11A to 11C are timing diagrams illustrating examples of waveforms of main signals generated in the current supply circuit of FIG. 10.

Referring to FIGS. 9A, 9B, 10, 11A, 11B, and 11C, the third node voltage VN3, the first resistance voltage VR1, the source-gate voltage Vsg_P2 (hereinafter referred to as P2 source-gate voltage) of the second P-type transistor MP2, the first current IL and the third current I3 may change depending on a change of the input signal VIN1.

Times of the first to fourth time points t1 to t4 of FIGS. 11A to 11C may be understood as specifying the first time point t1 of FIGS. 9A and 9B. That is, FIGS. 11A to 11C show waveforms of an operation in which the output signal VOUT rises in response to a rise of the input signal VIN1.

In a period before the first time point t1, both the input signal VIN1 and the output signal VOUT may have a low level VL. In this case, the first current I1 and the first auxiliary current Ix corresponding thereto are not generated.

During a first period between the first time point t1 and the second time point t2, the input signal VIN1 may transition from the low level VL to the high level VH. When the input signal VIN1 increases, the gate-source voltage of the first N-type transistor MN1 may increase. Accordingly, the size of the P2 source-gate voltage Vsg_P2 and the first current I1 may increase. The first current I1 may be copied to the third current I3 at a current ratio of 1/b, and the third current I3 may flow through the seventh N-type transistor MN7.

As the third current I3 increases, the first resistance voltage VR1 may increase, and the third node voltage VN3 may decrease to 0V. This process may be understood as the recursive feedback RECUR1 of the first current I1 during the first period. The P2 source-gate voltage Vsg_P2 may increase to a value (e.g. VDD−Vth_P3) obtained by a difference between the threshold voltage Vth_P3 of the third P-type transistor MP3 and the power voltage VDD due to the recursive feedback RECUR1 of the first current I1. Accordingly, the second P-type transistor MP2 may be completely turned on, and the first current I1 may have the maximum current value IMAX at the second time point t2.

The first current may quickly increase to the maximum current value IMAX in a very short first period between the first time point t1 and the second time point t2. The maximum current value IMAX may be again multiplied by K times and it may be provided to the output terminal OUT as the first auxiliary current Ix. Accordingly, the slew rate of the rising edge of the output signal VOUT may increase.

While the first current I1 increases to the maximum current value IMAX, the third node voltage VN3 decreases to the ground potential, so the drain-gate voltage of the seventh N-type transistor MN7 may become very small.

Accordingly, before the second time point t2, the third current I3 may approach zero.

From the second time point t2, the input signal VIN1 may have a high level VH. The gate voltage of the fifth N-type transistor MN5 may increase as the output signal VOUT rises toward the high level VH during the second period between the second time point t2 and the third time point t3. Accordingly, the third node voltage VN3 may increase, and the size of the third current I3 may increase. The third current I3 may rise to IMAX/b by the current mirror.

Since the first resistance voltage VR1 also increases due to the increase of the third current I3 during the second period, the P2 source-gate voltage Vsg_P2 may gradually decrease. Accordingly, during the second period, the first current I1 may maintain a level of the maximum current value IMAX. Accordingly, the first auxiliary current Ix based on the first current I1 of the maximum current value IMAX during the second period corresponding to the rising period of the output signal VOUT may be supplied to the output terminal OUT.

When the third current I3 reaches a value of IMAX/b at the third time point t3, the third node voltage VN3 may start to increase quickly. Accordingly, the P2 source-gate voltage Vsg_P2 may decrease during the third period between the third time point t3 and the fourth time point t4, so the first current I1 and the first auxiliary current Ix may quickly decrease. When the P2 source-gate voltage Vsg_P2 falls below the threshold voltage Vth_P2 of the second P-type transistor MP2, the first current I1 may become very small, and there is almost no output of the first auxiliary current Ix, so that the driving providing the auxiliary current in the current supply circuit 384 can be substantially terminated. Accordingly, after the fourth time point t4, both the input signal VIN1 and the output signal VOUT may maintain the high level VH. The third current I3 may be reduced by following the change of the first current I1.

Also, since the third node voltage VN3 increases to a level similar to the high level VH during the third period, the first resistance voltage VR1 may decrease close to zero.

In order to increase the slew rate of the output signal VOUT, the auxiliary current Ix or Iy having a large current value may be supplied until when the voltage of the input signal VIN and the voltage of the output signal VOUT becomes the same, and the auxiliary current Ix or Iy may be quickly reduced at when the voltage of the input signal VIN and the voltage of the output signal VOUT become the same, thereby terminating the supply of the auxiliary current in the current supply circuit 384. To this end, the maximum value of the first resistance voltage VR1 may be designed to be substantially the same as the threshold voltage Vth_P2 of the second P-type transistor MP2 (e.g., IMAX*R1/b=VR1_max≈Vth_P2). That is, when the voltage of the input signal VIN and the voltage of the output signal VOUT become the same at the third time point t3, the third current I3 may reach a value of IMAX/b. At this time, the first current I1 and the third current I3 may be quickly reduced at the corresponding time point, so that the supply of the auxiliary current in the current supply circuit 384 may be terminated. The first resistor R1 for maximizing the slew rate may be designed by Equation 1 below.

$$R1 = \frac{b}{IMAX} \cdot \text{Vth_P2} \quad \text{[Equation 1]}$$

Here, R1 may be resistance of the first resistor, IMAX may be the maximum current value of the first current I1, b may be a constant corresponding to the current ratio of the first current I1 and the third current I3, and Vth_P2 may be a threshold voltage of the P-type transistor MP2.

On the other hand, since the operation of the second current controller 3843 symmetrical to the first current controller 3842 is substantially the same as the operation of the first current controller 3842 described above except for the generation of the second current I2 and the second auxiliary current Iy under the condition that the input signal VIN1 decreases, a duplicate description will be omitted.

As described above, the output buffer BF according to the embodiments of the present inventive concept and the display device 1000 including the same may use the current supply circuit 384 connected in parallel to the buffer circuit 382 to instantaneously provide a very large auxiliary current Ix or Iy to the output terminal OUT when the input signal VIN1 transitions. Accordingly, the slew rate of the output signal VOUT may be improved. In addition, since the dead-zone range that deteriorates the output performance of the current supply circuit 384 can be reduced or minimized by the current controllers 3842 and 3843, the slew rate of the output signal VOUT can be maximized even when the voltage difference between the input signal VIN1 and the output signal VOUT is small.

In addition, the slew rate of the output signal VOUT may be further improved without large power consumption by the first bias current source I_S1 and the second bias current source I_S2.

Accordingly, the driving capability of the display device 1000 having a high driving frequency may be improved.

Further, the current supply circuit 384 included in the output buffer BF may be connected in parallel to various types of amplifiers as well as the buffer circuit 382 to be applied for general purpose. Thus, the slew rate of the output of the amplifier can be improved.

Figure 12:
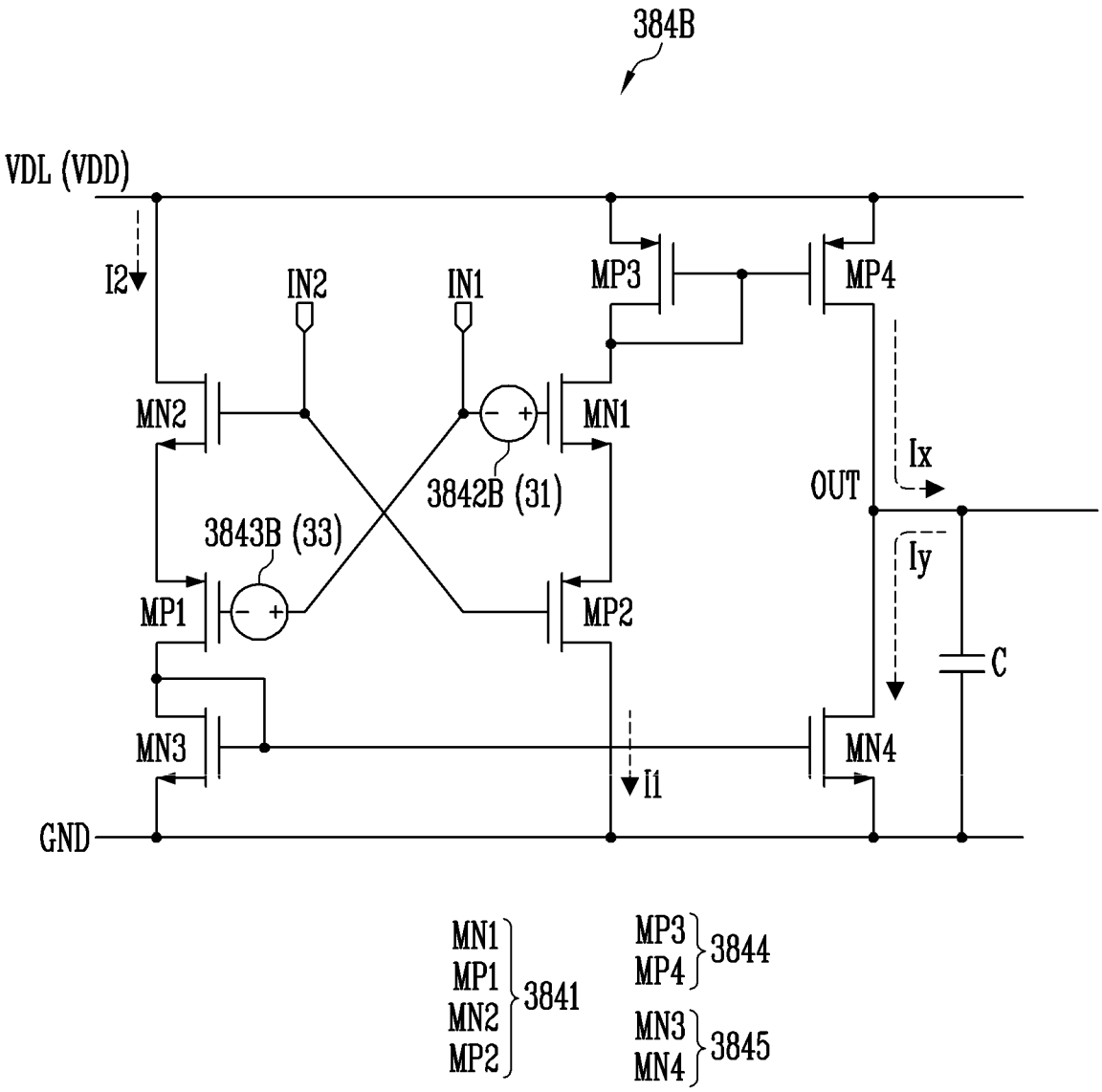
FIG. 12 is a circuit diagram illustrating an example of a current supply circuit included in the output buffer of FIG. 4.

FIG. 12 is a circuit diagram illustrating an example of a current supply circuit included in the output buffer of FIG. 4.

In FIG. 12, the same reference numerals are used for constituent elements described with reference to FIG. 6, and redundant descriptions of these constituent elements will be omitted.

Referring to FIG. 12, the current supply circuit 384B may include a current source generator 3841, a first current controller 3842B, a second current controller 3843B, a first current output 3844, and a second current output 3845.

In an embodiment, the first current controller 3842B may include a first constant voltage source 31 that controls a voltage of a gate electrode of the first N-type transistor MN1. In an embodiment, the second current controller 3843B may include a second constant voltage source 33 that controls a voltage of a gate electrode of the first P-type transistor MP1. That is, the current supply circuit 384B may have a structure in which the variable voltage sources 32 and 34 are omitted from the current supply circuit 384 of FIG. 6, and thus a manufacturing cost thereof may be reduced.

Figure 13:
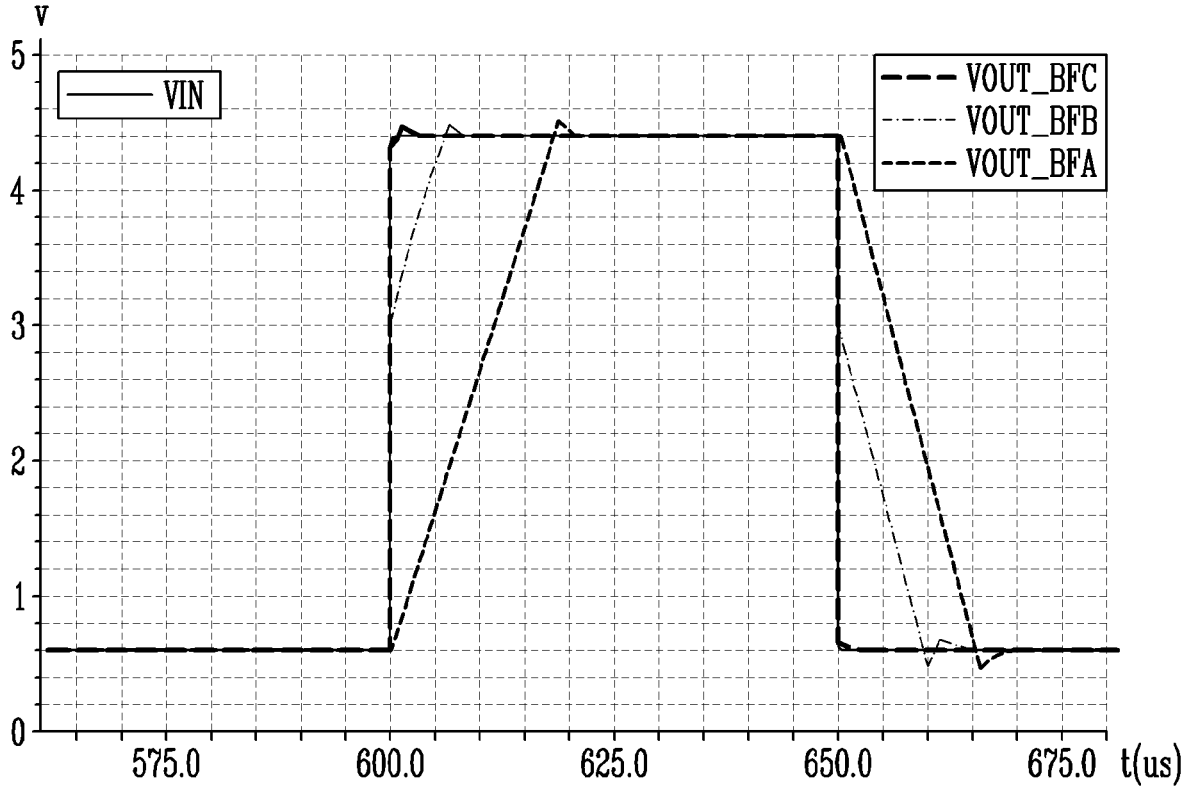
FIG. 13 is a drawing illustrating an example of a slew rate of an output signal according to a type of an output buffer.

FIG. 13 is a drawing illustrating an example of a slew rate of an output signal according to a type of an output buffer.

Referring to FIGS. 4 and 13, various types of output signals VOUT_BFA, VOUT_BFB, and VOUT_BFC may be output in response to the input signal VIN of a square wave.

The first output signal VOUT_BFA may be a waveform when the output buffer BF includes only the buffer circuit 382. The rising edge and the falling edge of the first output signal VOUT_BFA may be linearly output due to the linearity of the buffer circuit 382.

The second output signal VOUT_BFB may be a waveform when the output buffer BF includes the current supply circuit 384B of FIG. 12. The second output signal VOUT_BFB may have an improved slew rate than the first output signal VOUT_BFA.

The third output signal VOUT_BFC may be a waveform when the output buffer BF includes the current supply circuit 384 of FIG. 6 or 10. The third output signal VOUT_BFC may have an improved slew rate than the second output signal VOUT_BFB.

While the present inventive concept has been shown and described with reference to certain embodiments thereof, it will be understood by those skilled in the art that various changes in forms and details may be made therein without departing from the spirit and scope of the appended claims and their equivalents.

What is claimed is:

1. An output buffer applied to a display device, comprising:

a buffer circuit configured to output an output signal to an output terminal based on a first input signal provided to a first input terminal and a second input signal provided to a second input terminal; and a current supply circuit connected in parallel to the buffer circuit and configured to provide an auxiliary current to the output terminal based on the first input signal and the second input signal, wherein the current supply circuit comprises:

a current source generator connected to the first input terminal and configured to generate a first current provided to a first current path or a second current provided to a second current path based on the first input signal and the second input signal;

a first current controller connected between the second input terminal and the current source generator and configured to control the first current based on a third current generated by the first current;

a second current controller connected between the second input terminal and the current source generator and configured to control the second current based on a fourth current generated by the second current;

a first current output configured to provide a value obtained by multiplying the first current by k times (where k is a positive real number) as the auxiliary current to the output terminal; and a second current output configured to allow a value obtained by multiplying the second current by k times as the auxiliary current to flow from the output terminal to a ground.

2. The output buffer of claim 1, wherein the current source generator comprises:

a first P-type transistor connected between a power line and the ground, the first P-type transistor including a gate electrode connected to a first node connected to the first input terminal;

a first N-type transistor connected in parallel to the first P-type transistor between the power line and the ground, the first N-type transistor including a gate electrode connected to the first node;

a second P-type transistor connected between the first N-type transistor and the ground to form the first current path, the second P-type transistor including a gate electrode connected to the first current controller; and a second N-type transistor connected between the power line and the first P-type transistor to form the second current path, the second N-type transistor including a gate electrode connected to the second current controller.

3. The output buffer of claim 2, wherein the first current controller functions as a constant voltage source and a variable voltage source connected between the second input terminal and the gate electrode of the second P-type transistor, and the second current controller functions as a constant voltage source and a variable voltage source connected between the second input terminal and the gate electrode of the second N-type transistor.

4. The output buffer of claim 2, wherein the first current controller controls a voltage difference between a gate voltage of the first N-type transistor and a gate voltage of the second P-type transistor to be greater than a preset threshold.

5. The output buffer of claim 2, wherein the second current controller controls a voltage difference between a gate voltage of the second N-type transistor and a gate voltage of the first P-type transistor to be greater than a preset threshold.

6. The output buffer of claim 2, wherein the first current controller comprises:

a fifth N-type transistor connected between the power line and the ground, the fifth N-type transistor including a gate electrode connected to a second node connected to the second input terminal;

a sixth N-type transistor connected between the second P-type transistor and the ground, the sixth N-type transistor including a gate electrode and a drain electrode connected to each other;

a seventh N-type transistor connected between a third node and the ground, the seventh N-type transistor including a gate electrode connected to the gate electrode of the sixth N-type transistor; and a first resistor connected between the fifth N-type transistor and the third node, and wherein the gate electrode of the second P-type transistor is connected to the third node.

7. The output buffer of claim 6, wherein the first current controller further comprises:

an eighth P-type transistor connected between the power line and the fifth N-type transistor, the eighth N-type transistor including a gate electrode and a drain electrode connected to each other.

8. The output buffer of claim 6, wherein the sixth N-type transistor and the seventh N-type transistor are a current minor generating a current ratio of b:1 (where b is a real number of 1 or more), and wherein the third current flows through the seventh N-type transistor based on the first current.

9. The output buffer of claim 6, wherein the second current controller comprises:

a fifth P-type transistor connected between the power line and the ground, the fifth P-type transistor including a gate electrode connected to a second node connected to the second input terminal;

a sixth P-type transistor connected between the power line and the second N-type transistor, the sixth P-type transistor including a gate electrode and a drain electrode connected to each other;

a seventh P-type transistor connected between a fourth node and the ground, the seventh P-type transistor including a gate electrode connected to the gate electrode of the sixth P-type transistor; and a second resistor connected between the fourth node and the fifth P-type transistor, and wherein the gate electrode of the second N-type transistor is connected to the fourth node.

10. The output buffer of claim 9, wherein the second current controller further comprises:

an eighth N-type transistor that is connected between the fifth P-type transistor and the ground, the eighth N-type transistor including a gate electrode and a drain electrode connected to each other.

11. The output buffer of claim 9, wherein the sixth P-type transistor and the seventh P-type transistor are a current minor generating a current ratio of b:1 (where b is a real number of 1 or more), and wherein the fourth current flows through the seventh P-type transistor based on the second current.

12. The output buffer of claim 9, wherein the current supply circuit comprises:

a first bias current source connected between the third node and the ground; and a second bias current source connected between the power line and the fourth node.

13. The output buffer of claim 2, wherein the first current output comprises:

a third P-type transistor connected between the power line and the first N-type transistor, the third P-type transistor including a gate electrode and a drain electrode connected to each other; and a fourth P-type transistor connected between the power line and the output terminal, the fourth P-type transistor including a gate electrode connected to the gate electrode of the third P-type transistor.

14. The output buffer of claim 2, wherein the second current output comprises:

a third N-type transistor connected between the first P-type transistor and the ground, the third N-type transistor including a gate electrode and a drain electrode connected to each other; and a fourth N-type transistor connected between the output terminal and the ground, the fourth N-type transistor including a gate electrode connected to the gate electrode of the third N-type transistor.

15. A data driver comprising:

a digital-to-analog converter configured to convert digital image data into an analog data signal; and an output buffer configured to provide the analog data signal to a data line connected to the display panel, wherein the output buffer comprises:

a buffer circuit configured to output the analog data signal to an output terminal based on a first input signal provided to a first input terminal and a second input signal provided to a second input terminal; and a current supply circuit connected in parallel to the buffer circuit, and configured to provide an auxiliary current to the output terminal based on the first input signal and the second input signal, wherein the analog data signal is provided to the second input terminal, wherein the current supply circuit comprises:

a current source generator connected to the first input terminal and configured to generate a first current provided to a first current path or a second current provided to a second current path based on the first input signal and the analog data signal;

a first current controller connected between the second input terminal and the current source generator and configured to control the first current based on a third current generated by the first current;

a second current controller connected between the second input terminal and the current source generator and configured to control the second current based on a fourth current generate by the second current;

a first current output configured to provide a value obtained by multiplying the first current by k times (where k is a positive real number) as the auxiliary current to the output terminal; and a second current output configured to allow a value obtained by multiplying the second current by K times (where K is a positive real number) as the auxiliary current to flow from the output terminal to a ground.

16. A display device comprising:

a display panel including pixels;

a scan driver supplying scan signals to the pixels through scan lines; and a data driver including a digital-to-analog converter for converting digital image data to an analog data signal, and an output buffer for providing the analog data signal to data lines connected to the display panel, wherein the output buffer comprises:

a buffer circuit configured to output the analog data signal to an output terminal based on a first input signal provided to a first input terminal and a second input signal provided to a second input terminal; and a current supply circuit connected in parallel to the buffer circuit, and configured to provide an auxiliary current to the output terminal based on the first input signal and the second input signal, wherein the current supply circuit comprises:

a current source generator connected to the first input terminal and configured to generate a first current provided to a first current path or a second current provided to a second current path based on the first input signal and the second input signal;

a first current controller connected between the second input terminal and the current source generator and configured to control the first current based on a third current generated by the first current;

a second current controller connected between the second input terminal and the current source generator and configured to control the second current based on a fourth current generated by the second current;

a first current output configured to provide a value obtained by multiplying the first current by k times (where k is a positive real number) as the auxiliary current to the output terminal; and a second current output configured to allow a value obtained by multiplying the second current by k times as the auxiliary current to flow from the output terminal to a ground, and wherein the analog data signal is provided to the second input terminal.

* * * * *